US008096343B2

(12) United States Patent
Whitton

(10) Patent No.: US 8,096,343 B2
(45) Date of Patent: Jan. 17, 2012

(54) METHOD FOR PRECISION CASTING OF METALLIC COMPONENTS WITH THIN PASSAGE DUCTS

(75) Inventor: Richard Whitton, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 155 days.

(21) Appl. No.: 12/073,622

(22) Filed: Mar. 7, 2008

(65) Prior Publication Data

US 2008/0216983 A1 Sep. 11, 2008

(30) Foreign Application Priority Data

Mar. 9, 2007 (DE) ..... 10 2007 012 321

(51) Int. Cl.
*B22C 7/02* (2006.01)
*B22C 9/00* (2006.01)
*B22C 9/04* (2006.01)

(52) U.S. Cl. ..... 164/35; 164/45; 164/516; 164/361

(58) Field of Classification Search ..... 164/516, 164/35, 45, 361, 369
See application file for complete search history.

(56) References Cited

U.S. PATENT DOCUMENTS

| | | | | |
|---|---|---|---|---|
| 3,142,875 | A | 8/1964 | Lirones | |
| 3,758,317 | A * | 9/1973 | Moore et al. | 501/95.1 |
| 4,561,491 | A | 12/1985 | Slack | |
| 5,143,777 | A | 9/1992 | Mills | |
| 5,291,654 | A * | 3/1994 | Judd et al. | 29/889.721 |
| 5,318,094 | A | 6/1994 | Joy | |
| 5,641,014 | A | 6/1997 | O'Connor | |
| 5,921,309 | A | 7/1999 | Nishida | |
| 6,029,736 | A | 2/2000 | Naik | |
| 6,352,101 | B1 | 3/2002 | Ghosh | |
| 6,364,000 | B2 | 4/2002 | Naik | |
| 6,431,255 | B1 | 8/2002 | Ghosh | |
| 6,460,599 | B1 | 10/2002 | Naik | |
| 6,557,621 | B1 * | 5/2003 | Dierksmeier et al. | 164/369 |
| 6,568,458 | B2 | 5/2003 | Naik | |
| 6,720,028 | B1 | 4/2004 | Haaland | |
| 7,036,556 | B2 | 5/2006 | Caputo | |
| 7,093,645 | B2 | 8/2006 | Grunstra | |
| 7,234,506 | B2 | 6/2007 | Grunstra | |
| 7,278,460 | B2 | 10/2007 | Grunstra | |
| 2003/0183364 | A1 | 10/2003 | El-Demallawy | |
| 2004/0055736 | A1 | 3/2004 | Schneiders | |
| 2004/0166349 | A1 | 8/2004 | Haaland | |
| 2005/0169762 | A1 | 8/2005 | Blume | |

(Continued)

FOREIGN PATENT DOCUMENTS

| | | |
|---|---|---|
| AT | 190226 | 7/1956 |

(Continued)

*Primary Examiner* — Kevin P Kerns
(74) *Attorney, Agent, or Firm* — Timothy J. Klima; Shuttleworth & Ingersoll, PLC

(57) ABSTRACT

In precision casting of metallic components with very thin passage ducts, in particular turbine blades, by the lost-wax process, the ceramic core pins provided for forming the passage ducts are covered and stabilized via a low-melting reinforcing coat prior to injection of the wax material required for forming the wax pattern for the production of the ceramic casting mold, with the low-melting reinforcing coat being melted out together with the wax material after the casting mold has been formed on. The ceramic core pins are therefore not damaged during the production of the wax pattern, enabling very thin passage ducts to be formed in the precision casting process.

4 Claims, 1 Drawing Sheet

U.S. PATENT DOCUMENTS

2005/0274478 A1 12/2005 Verner

FOREIGN PATENT DOCUMENTS

Figure 1:
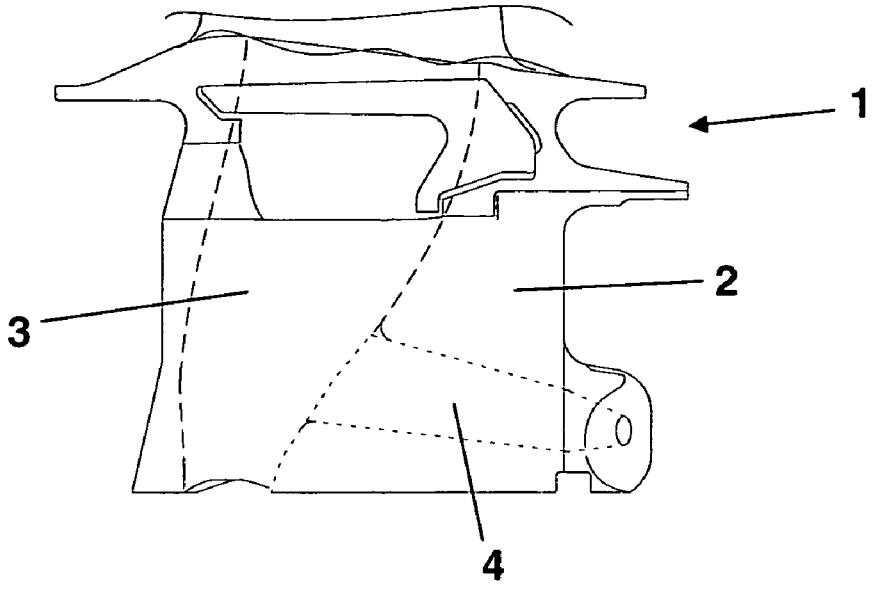

| | | | | |
|---|---|---|---|---|
| DE | 2947 | | | 8/1953 |
| DE | 1 100 233 | A | | 2/1961 |
| DE | 1 172 807 | A | | 6/1964 |
| DE | 1 263 225 | A | | 3/1968 |
| DE | 1 289 294 | A | | 2/1969 |
| DE | 29 44 534 | A1 | | 5/1980 |
| DE | 690 08 419 | T2 | | 8/1994 |
| DE | 691 06 381 | T2 | | 5/1995 |
| DE | 102 12 377 | A1 | | 10/2002 |
| DE | 103 46 366 | A1 | | 4/2005 |
| DE | 698 32 559 | T2 | | 8/2006 |
| DE | 698 35 646 | T2 | | 8/2007 |
| EP | 0 873 803 | A1 | | 10/1998 |
| EP | 1 098 723 | B1 | | 5/2001 |
| EP | 1 098 724 | B1 | | 5/2001 |
| EP | 1 351 785 | B1 | | 10/2003 |
| EP | 1 671 720 | A1 | | 6/2006 |
| GB | 2 042 951 | A | | 10/1980 |
| GB | 2 150 874 | A | | 7/1985 |
| JP | 2000-246392 | A | * | 9/2000 |
| JP | 2000 246392 | A | | 9/2000 |
| WO | WO 2005/084220 | A2 | * | 9/2005 |

* cited by examiner

METHOD FOR PRECISION CASTING OF METALLIC COMPONENTS WITH THIN PASSAGE DUCTS

This application claims priority to German Patent Application DE102007012321.5 filed Mar. 9, 2007, the entirety of which is incorporated by reference herein.

This invention relates to a method for precision casting of metallic components with very thin passage ducts, more particularly of turbine blades, by the lost-wax process, in which a wax pattern is produced by injecting wax material between die shells and a ceramic core disposed therein and, after removal of the die shells, a ceramic casting mold is produced on the outer surface of the wax pattern in a dipping and sanding process which, upon melting out the wax, is fired and into which molten metal is then poured, with the casting mold and the core subsequently being destroyed and removed.

It is known to manufacture turbine blades provided with cooling air holes by the lost-wax process. In the lost-wax process, a non-meltable die (wax pattern mold, die shells) made from a master pattern is used to produce a wax pattern from a meltable material, typically special wax, in a casting process. In the next step, the wax patterns, which are provided with a gating system, are assembled to pattern clusters and then covered with refractory-grade material by multiple dipping and sanding. The wax pattern is then melted out and the remaining mold in refractory-grade material fired to produce a ceramic casting mold. Liquid metal is poured into the ceramic casting molds so created to produce the desired components. Upon solidification of the metal, the ceramic casting molds are destroyed. This process, which is also termed precision casting, enables intricate casting parts in different metallic materials, typically turbine blades in so-called aerospace material, to be produced precisely and with high surface finish.

In a method known for example from Specification US 2004/0055736 A1 for the production of hollow turbine blades with cooling ducts provided therein, a ceramic core is sprayed with wax and a ceramic casting mold then produced around the wax layer by repeated immersion in a ceramic binder and sanding which is fired after removal of the wax. After the wax has been melted out, liquid metal is poured into the space left between the core and the die shell to produce the turbine blade. Movements of the core during the pouring process can be avoided by metallic positioning aids provided in the ceramic core. Upon pouring and solidification of the metal, the ceramic core and the ceramic casting shell are destroyed and removed. Subsequently, the casting is mechanically machined and the positioning aids are removed. For the formation of cooling ducts, the ceramic core is provided with profiles.

Since low cooling-air consumption increases the efficiency of the gas-turbine engine, the diameter of the cooling-air ducts must be kept as small as possible.

Such thin passage holes in a turbine blade are not producible by the above mentioned precision casting process—which is characterised by wax melting—because the very thin and also brittle ceramic core material for forming the ducts is likely to fail when the wax material for the production of the casting mold is applied or injected. Therefore, turbine blades with cooling-air ducts of very small diameters are not producible by precision casting. Consequently, turbine blades are cost-effectively producible by precision casting only by accepting a design which affects the efficiency of the engine (large cooling-air duct diameter), or the advantageously thin holes must be produced in the blade in a subsequent, separate process step, with negative consequences on cost.

It is a broad aspect of the present invention to provide, on the basis of the lost-wax process, a precision casting method for the production of turbine blades with passage ducts which enables even very thin passage ducts to be produced within the casting process.

In inventive precision casting of metallic components with very thin passage ducts by the lost-wax process, in particular in the manufacture of turbine blades with passage ducts for cooling air in the blade root, in the platform or in the wall of the hollow-type airfoil, the thin ceramic core pins provided for forming the passage ducts are covered and stabilised by use of a low-melting reinforcing coat prior to injection of the wax material for forming the wax pattern for the subsequent production of the ceramic casting mold for casting the component, with the low-melting reinforcing coat being melted out together with the wax material of the wax pattern after the casting mold has been formed on.

The ceramic core pins disposed in the wax pattern mold can be formed onto a ceramic core which is provided in the wax pattern mold to produce a cavity in the respective component.

The reinforcing coat may include wax or similar thermoplastic materials which melt out together with the wax pattern material.

According to a further significant feature of the present invention, fibers are incorporated into the reinforcing coat to improve strength and stiffness of the reinforcing coat.

The method according to the present invention allows cooling-air ducts with diameters appropriately small to improve engine efficiency and in various shapes, for example conical and/or curved, to be produced within the precision casting process for the manufacture of turbine blades, i.e. without additional processing steps.

This invention is more fully described in light of the accompanying drawings showing a preferred embodiment. In the drawings, FIG. 1 is a sectional view of a portion of a turbine blade produced by precision casting, with a micro-turbine nozzle being integrally formed in the turbine blade root in the casting process, and FIG. 2 is an enlarged schematic representation of a ceramic core for the formation of the cavity and the micro-turbine nozzle originating from this cavity in the turbine blade according to FIG. 1.

As per the partial illustration of a turbine blade 1 in FIG. 1, a passage duct 4 with very small diameter, which conveys cooling air and acts as a micro-turbine nozzle, originates at a cavity 3 provided in the blade root 2. Both cavity 3 and passage duct 4 are produced together with the turbine blade by precision casting according to the lost-wax process.

Figure 2:
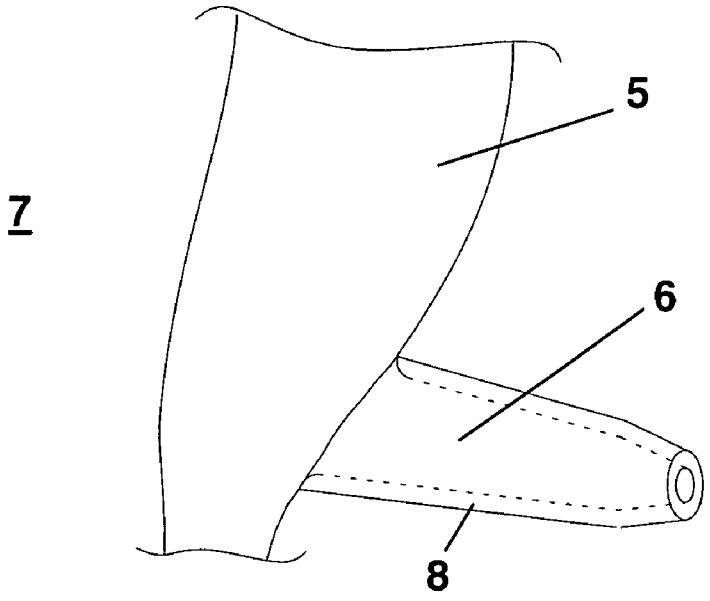

FIG. 2 shows the ceramic core 5 for the formation of the cavity 3 and the thin, integrally formed ceramic core pin 6 for the formation of the equally thin passage duct 4 which—as per the lost-wax process—is first enclosed with wax material 7 injected into a wax pattern mold (not shown) comprising firm die shells to produce the ceramic casting mold. The outer contour of the wax material, on whose outer surface the hard ceramic casting mold (either not shown) will subsequently be formed, corresponds, upon removal of the wax pattern mold (die shells), to the inner contour of the mold for casting the molten metal or to the outer contour of the turbine blade, respectively, while the outer contour of the ceramic core 5 and the ceramic core pin 6 represent the contour of the cavity 3 and of the thin passage duct 4 (micro-turbine nozzle) in the blade root 2. Since the ceramic core pin 6 is very brittle and, due to its small diameter, susceptible to failure during application or injection of the wax material 7, it is enclosed with a meltable reinforcing coat 8 prior to introduction of the wax material 7, thereby preventing it from being destroyed or damaged during this operation. Upon removal of the wax pattern die shells and subsequent production of a ceramic casting mold by repeated immersion of the wax pattern into a ceramic binder and interim sanding, the injected wax material 7 and the meltable reinforcing coat 8 are melted out and the ceramic casting mold is fired. The molten metal alloy specified for the turbine blade is then poured into the ceramic casting mold. In the subsequent process step, the ceramic casting mold and the ceramic core 5 as well as the ceramic core pin 6 are destroyed and removed.

The meltable reinforcing coat can include wax, fiber-reinforced wax or other thermoplastic material which readily melts out together with the wax from the ceramic casting mold.

The present invention is not limited to the above application. It may be applied for turbine blades or other components made by lost-wax casting when thin ducts are not producible within the casting process due to the susceptibility of the—correspondingly thin—ceramic core and separate manufacture of the thin passage ducts by other methods is too costly, for example in the case of a supporting structure in the area of the stator blades of a turbine stage for the formation of a very narrow pre-swirl nozzle or of very thin ducts in the turbine blade tips.

LIST OF REFERENCE NUMERALS

1 Turbine blade
2 Blade root
3 Cavity
4 Passage duct (pre-swirl nozzle)
5 Ceramic core
6 Ceramic core pin
7 Wax material
8 Reinforcing coat

What is claimed is:

1. A method for precision casting of metallic components with at least one very thin passage duct by the lost-wax process, comprising:

producing a wax pattern by injecting wax material between die shells having at least one ceramic core pin disposed therein;

removing the die shells;

thereafter producing a ceramic casting mold on an outer surface of the wax pattern in a dipping and sanding process which, upon melting out the wax material, is fired and into which molten metal is then poured, with the casting mold and the at least one ceramic core pin subsequently being destroyed and removed after the poured molten metal has solidified to create the precision casting having the at least one very thin passage duct therein;

wherein the at least one ceramic core pin is formed in a diameter corresponding to a diameter of the at least one very thin passage duct;

spraying a sprayable meltable reinforcing coat onto the at least one ceramic core pin and then solidifying the reinforcing coat prior to injecting the wax material to coat, stabilize and reinforce the at least one ceramic core pin and prevent breakage of the at least one ceramic core pin during injection of the wax material, the wax material being injected to be in contact with the at least one reinforcing coated ceramic core pin, with the meltable reinforcing coat being melted out together with the wax material; and incorporating fiber material into the reinforcing coat before injection of the wax material.

2. The method of claim 1, wherein the reinforcing coat includes at least one of wax and another thermoplastic material.

3. The method of claim 2, wherein the at least one ceramic core pin is at least one of conical and curved according to a shape of the passage duct.

4. The method of claim 1, wherein the at least one ceramic core pin is at least one of conical and curved according to a shape of the passage duct.

* * * * *